United States Patent [19]

Dullabaun

[11] Patent Number: 4,549,667

[45] Date of Patent: Oct. 29, 1985

[54] TAMPER INDICATING PACKAGE

[75] Inventor: Paul W. Dullabaun, Toledo, Ohio

[73] Assignee: Owens-Illinois, Inc., Toledo, Ohio

[21] Appl. No.: 589,789

[22] Filed: Mar. 15, 1984

[51] Int. Cl.[4] ..... B65D 7/28

[52] U.S. Cl. ..... 215/252; 215/253; 215/258

[58] Field of Search ..... 215/252, 253, 258, 250

[56] References Cited

U.S. PATENT DOCUMENTS

| | | | |
|---|---|---|---|
| 3,673,761 | 7/1972 | Leitz | 215/253 X |
| 3,927,784 | 12/1975 | Cochrane | 215/258 X |
| 4,461,390 | 7/1984 | Csaszar | 215/258 X |

*Primary Examiner*—Steven M. Pollard
*Attorney, Agent, or Firm*—John R. Nelson

[57] ABSTRACT

A tamper indicating package comprising a container having a neck with external threads formed thereon and a plastic closure comprising a top panel and an integral depending annular skirt. The skirt has integral internal threads formed thereon complementary to the threads on the neck of the container. The container has an annular locking bead positioned axially below the threads, and the skirt has a ring at the lower end thereof connected to the upper portion of the skirt by a plurality of circumferentially spaced integral bridge portions located below the threads when the closure is on the container. The ring has a radially inwardly extending annular rib engaging beneath the locking bead of the container when the closure is on the container. The skirt has an annular groove formed therein in the area of the bridge portions, the groove being formed after molding by deforming an annular portion of the skirt thereby displacing material in the annular area axially and stressing the material in the annular area.

12 Claims, 8 Drawing Figures

TAMPER INDICATING PACKAGE

This invention relates to packages in particularly to tamper indicating packages.

BACKGROUND AND SUMMARY OF THE INVENTION

In the packaging of various commodities, it has become desirable to provide some indication as to whether the contents had been tampered with. In such packages, one common expedient has been to form a ring on the closure of the container which is broken or severed when attempts are made to remove the closure. In one type of such package, that is shown for example in U.S. Pat. Nos. 3,329,290, 3,784,041, 4,322,009 and 4,343,308, the closure includes an integral pilfer ring that snaps over an annular bead on the container and is fractured or severed from the closure when the closure is removed. As shown in U.S. Pat. No. 4,322,009, the pilfer ring is connected to the remainder of the skirt by bridge portions formed in the skirt after molding of the closure by slitting the skirt circumferentially. In U.S. Pat. No. 4,343,308, an attempt is made to control the fracture of the pilfer ring by molding the closure with a groove on the periphery of the skirt in order to accurately control the thickness of the skirt from about 0.003 inches to 0.005 inches.

Although such tamper indicating packages are satisfactory for the purpose of indicating tampering, the presence of the tamper or pilfer ring raises problems during the application of the closure to the container. In the process of applying the closure, the pilfer band is subjected to a series of stresses which tend to break the band away from the remainder of the closure in which case the tamper indicating feature of the package will be lost. More specifically, as the closure is threaded onto the container, the pilfer band bridge portions and skirt are subjected to a compressive action against the annular bead on the container and thereafter a flexing of the bridge portions of the pilfer band by displacement radially outwardly over the annular bead and finally by snapping action to an axial stress. If the bridge portions are made stronger to prevent damage, then the closure is apt to be more difficult to remove or the pilfer band will not function by breaking away from the skirt, or both of these could result.

Accordingly, among the objectives of the present invention are to provide a tamper indicating package which includes a closure that can be applied to the container without damage and yet can be readily removed by the user during which removal the pilfer ring functions to indicate that the closure has been removed or possibly tampered with.

In accordance with the invention, an annular groove is formed into the closure in the area of the bridge portions by deforming the area radially after the closure is molded and prior to slitting to form the bridge portions. This displaces the material axially lengthening the skirt and at the same time making the area of the skirt thinner but stressed such that it will more readily withstand the stresses of applying the closure to the container.

DESCRIPTION

Figure 1:
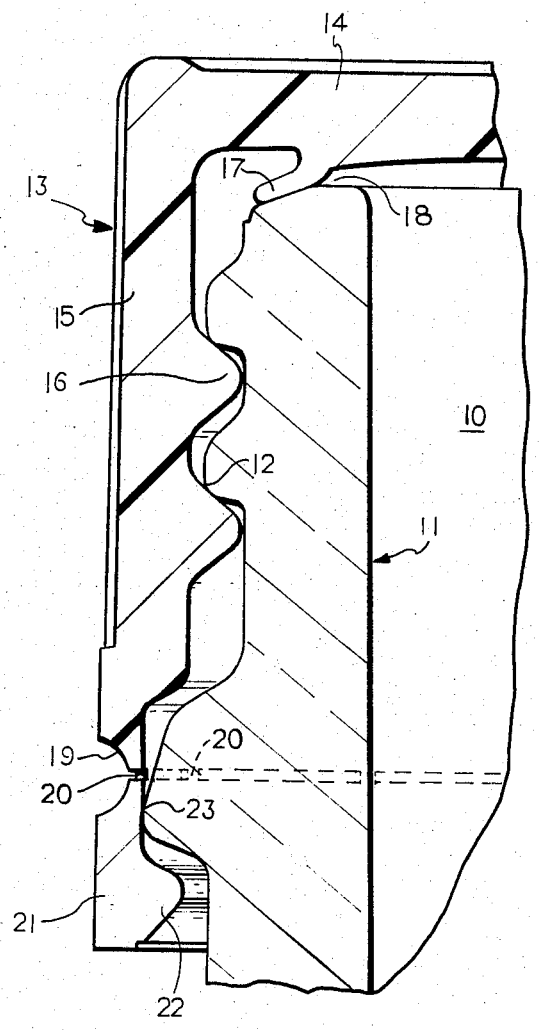
FIG. 1 is a fragmentary sectional view of a tamper indicating package embodying the invention.
Figure 4:
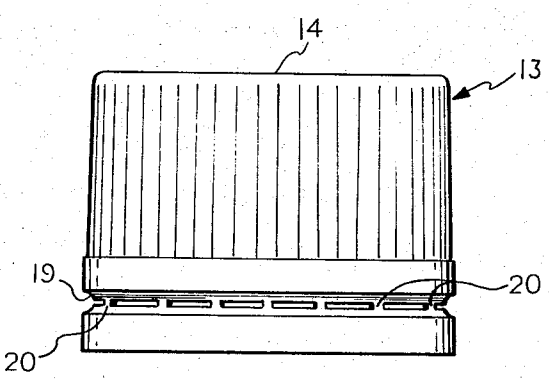
FIG. 4 is an elevational view of the closure after forming the bridge portions by slitting.
Figure 3:
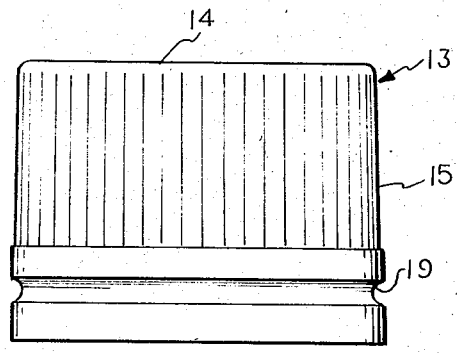
FIG. 3 is an elevational view of the closure after forming an annular groove in the periphery of the skirt.
Figure 2:
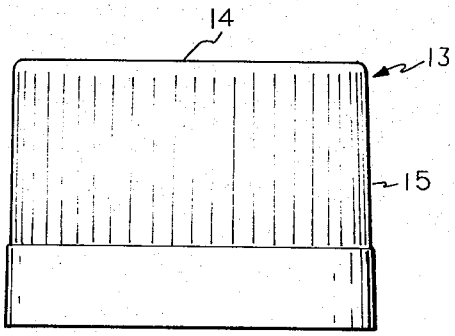
FIG. 2 is an elevational view of the closure after molding.

Referring to FIG. 1, the package embodying the invention comprises a container 10 having a neck 11 with external threads 12 thereon and a plastic closure 13 including a top panel 14 and a peripheral skirt 15 having internal threads 16 for engaging the threads 12. The top panel may have an annular rib 17 adapted to engage the upper end 18 of the container. The container may be made of glass or plastic. The closure 13 is preferably made of plastic such as polypropylene. The closure may be made by injection molding the plastic.

In accordance with the invention, an annular groove 19 is cold formed on the exterior surface of the skirt after the closure is molded by deforming the material of the skirt radially inwardly. This displaces the material of the skirt radially inwardly and stresses the material in the area of the groove and at the same time lengthens the skirt. Groove 19 is preferably symmetrical and U-shaped in cross section. After the groove is formed, the bridge portions 20 and pilfer ring 21 are formed by slitting as with a knife circumferentially at the base of the grooves. The pilfer ring 21 includes a radially inwardly extending rib 22 near its lower edge which extends beneath an annular locking bead 23 that is below the threads on the container.

Figure 7:
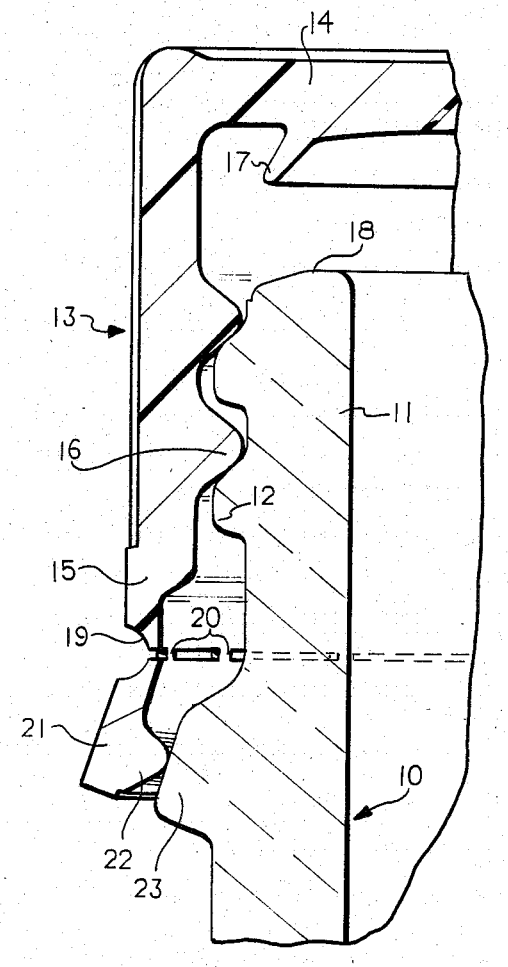
FIG. 7 is a fragmentary sectional view showing the application of the closure to the container.

The resultant closure has been strengthened in the area of the bridge portions 20 so that when the closure is applied to the container, it will withstand the stresses to which the closure and particularly the bridge portions are subjected. Specifically, as the closure is threaded on the containers, the bridge portions 20 will withstand the compressive force or stresses first encountered by engagement of the annular rib 22 on the lower edge of the ring with the annular locking bead 23 on the container. As the closure is further threaded on the container as shown in FIG. 7, the bridge portions 20 will withstand the flexing force as the annular rib 22 moves radially outwardly over the annular locking bead 23 and finally the bridge portions will withstand the further flexing caused by the rib 22 flexing over the bead 23.

When the closure is rotated to unthread the closure from the container, the interaction of the threads 12 on the container 10 and the threads 16 on the closure 13 provide a force axially on each of the bridge portions 20 such that they are fractured or broken to indicate that the closure has been removed or tampered with.

Figure 5:
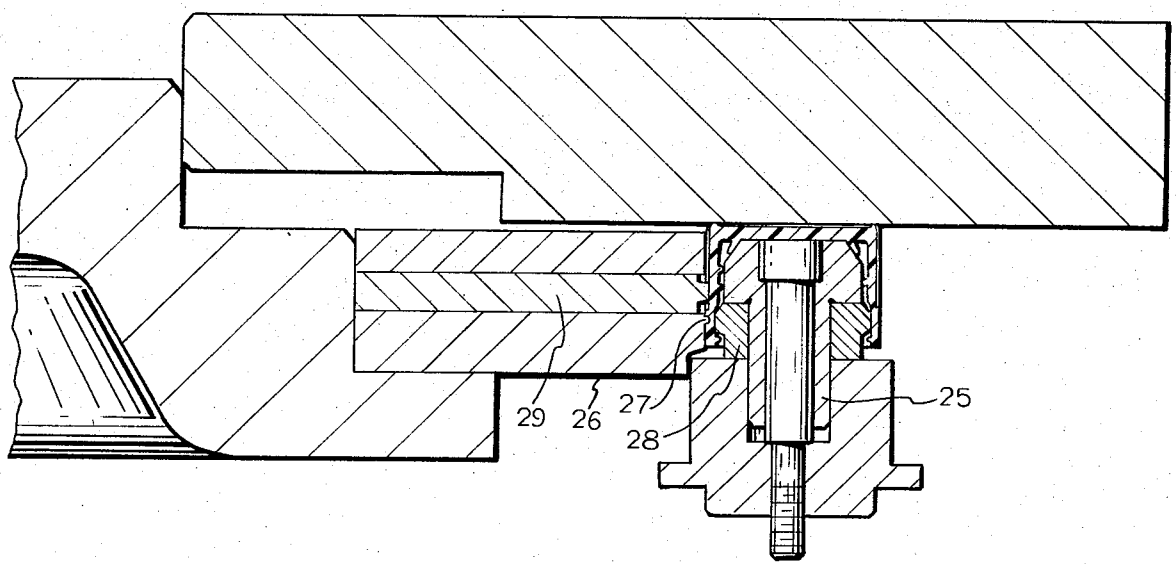
FIG. 5 is a fragmentary view of an apparatus for forming the annular groove in the closure skirt.

Referring to FIG. 5, an apparatus for forming the groove is shown and comprises a mandrel 25 on which the closure is mounted after molding. The mandrel 25 is rotatably mounted on the periphery of a plate or wheel (not shown) that is rotated to move the mandrel 25 past an annular grooving tool 26 which extends along the path of the mandrel 25. The grooving tool 26 functions to deform the wall of the skirt and form the groove 19.

Figure 6:
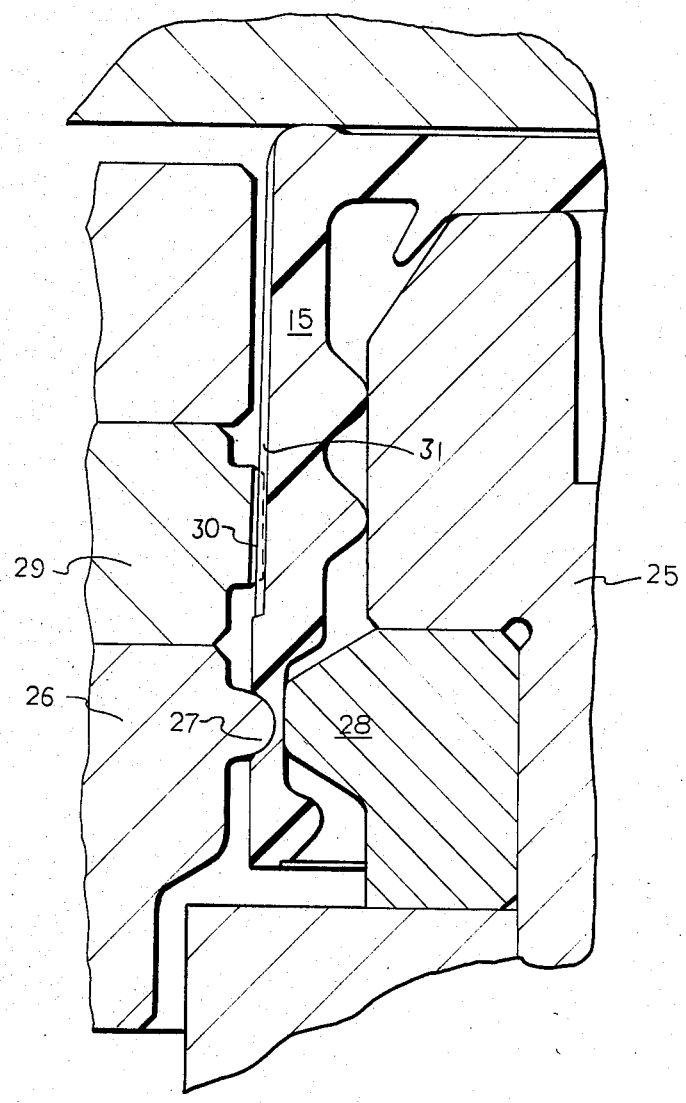
FIG. 6 is a fragmentary view on an enlarged scale of the apparatus for forming the closure groove.

As shown in FIG. 6, the tool has an arcuate tip 27 that cooperates with an anvil portion 28 of the mandrel 25 to cold form and define the groove 19 so that the material of the closure is displaced axially. A fixed tool 29 is provided alongside the grooving tool and has teeth 30 that engage serrations 31 on the periphery of skirt 15 to rotate the closure and mandrel 25 as they are moved past the grooving tool 26.

Figure 8:
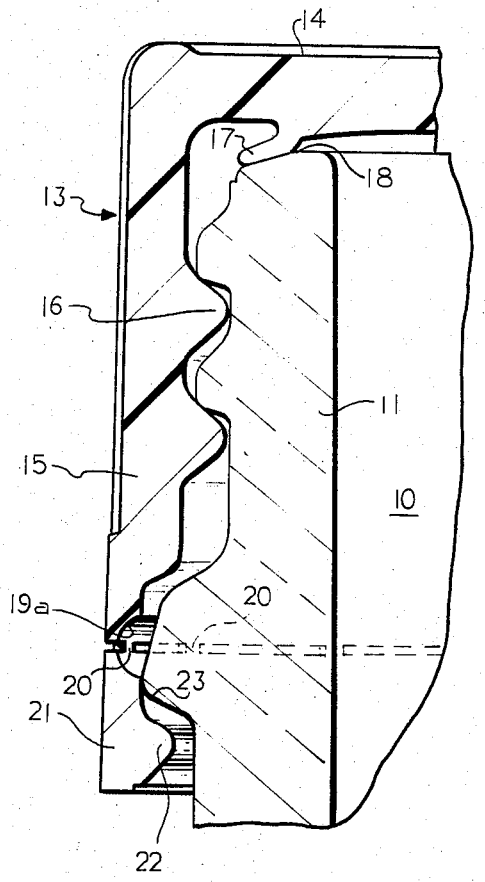
FIG. 8 is a fragmentary sectional view showing a modified tamper indicating package.

Although the groove 19 has been shown as formed in the external surface of the closure, the groove may alternatively be formed on the internal surface, as shown at 19*a* in FIG. 8.

Tests have indicated that the stresses to which the bridge portions 20 can be subjected without fracture are substantially increased by the formation of the groove in the skirt after the closure is molded.

Although I do not wish to be bound by the theory involved, in my opinion, the cold forming of the groove 19 in the area of the bridge portions 20 after molding of the closure and before forming the bridge portions 20 by slitting subjects the material in the area of the bridge portions 20 to residual interal stresses and also orients the plastic material such that the material will withstand greater compressive, tensile and flexing stresses.

I claim:

1. A tamper indicating package comprising a container having a neck with external threads formed thereon, said container having an annular locking bead positioned axially below the threads, a plastic closure comprising a top panel and an integral depending annular skirt, said skirt having integral internal threads formed thereon complementary to the threads on the neck of the container, said skirt having an annular groove cold formed therein defining a ring connected to the upper portion of the skirt by a plurality of circumferentially spaced integral bridge portions located in the groove and defining a weakened portion, said ring having a radially inwardly extending annular rib engaging beneath the locking bead of the container when the closure is on the container, said groove being cold formed after molding of the closure by deforming an annular portion of the skirt thereby displacing material in the annular area axially and increasing the length of the skirt and stressing the material in said annular area such that the bridge portions are stressed so that they are strengthened to withstand the compression stresses encountered by engagement of the annular rib on the ring with the annular locking bead of the container and the flexing force on the bridge portions as the annular rib moves radially outwardly over the annular locking bead and flexes inwardly as the closure is applied to the container and such that the bridge portions can be readily broken when the closure is being removed or tampered with.

2. The tamper indicating package set forth in claim 1 wherein said groove is on the exterior surface of said skirt.

3. The tamper indicating package set forth in claim 2 wherein said groove is symmetrical and generally U-shaped in cross section.

4. The tamper indicating package set forth in claim 1 wherein said groove is on the interior surface of said skirt and is symmetrical and generally U-shaped in cross section.

5. A tamper indicating closure comprising a plastic body comprising a top panel and an integral depending annular skirt, said skirt having integral internal threads formed thereon adapted to engage complementary threads on the neck of a container, said skirt having a ring at the lower end thereof below the threads when the closure is on a container, said ring having a radially inwardly extending annular rib engaging beneath the locking bead of the container when the closure is on the container, said skirt having an annular groove cold formed therein in the area of the bridge portions, a plurality of circumferentially spaced integral bridge portions located in the groove, said groove being cold formed after molding by deforming an annular portion of the skirt thereby displacing material in the annular area axially and stressing the material in said annular area such that the bridge portions are stressed so that they are strengthened to withstand the compression stresses encountered by engagement of the annular rib on the ring with the annular locking bend of a container and the flexing force on the bridge portions as the annular rib moves radially outwardly over the annular locking bead and flexes inwardly as the closure is applied to a container and such that the bridge portion can be readily broken when the closure is being removed or tampered with.

6. The tamper indicating package set forth in claim 5, wherein said groove is on the exterior surface of said skirt.

7. The tamper indicating package set forth in claim 6 wherein said groove is symmetrical and generally U-shaped in cross section.

8. The tamper indicating package set forth in claim 5 wherein said groove is on the interior surface of said skirt and is symmetrical and generally U-shaped in cross section.

9. In the making of a plastic closure comprising a top panel, an integral dependent annular skirt, integral internal threads formed on the skirt, wherein the closure is molded, the method which comprises cold forming an annular groove in the skirt after the skirt is molded by deforming an annular portion of the skirt radially thereby displacing material from the annular area axially and increasing the length of the skirt and stressing the material in the groove that is formed such that the bridge portions are stressed so that they are strengthened to withstand the compression stresses encountered by engagement of the annular rib on the ring with the annular locking bend of a container and the flexing force on the bridge portions as the annular rib moves radially outwardly over the annular locking bead and flexes inwardly as the closure is applied to a container and such that the bridge portion can be readily broken when the closure is being removed or tampered with.

10. The method as set forth in claim 9 including the step of forming bridge portions in the area of the groove after forming the groove by slitting the skirt circumferentially in the area of the groove.

11. The method set forth in claim 10 wherein the step of cold forming said groove is applied radially inwardly on the exterior surface of said skirt.

12. The method set forth in claim 10 wherein the step of cold forming said groove is applied radially outwardly on the interior surface of said groove.

* * * * *

UNITED STATES PATENT AND TRADEMARK OFFICE

CERTIFICATE OF CORRECTION

PATENT NO. : 4,549,667

DATED : October 29, 1985

INVENTOR(S) : Paul W. Dullabaun

It is certified that error appears in the above-identified patent and that said Letters Patent are hereby corrected as shown below:

Col. 3, line 22, "interal" should be --internal--.

Col. 4, Claim 9, line 52, "bend" should be --bead--.

Signed and Sealed this

*Twenty-seventh* Day of *May 1986*

[SEAL]

*Attest:*

DONALD J. QUIGG

*Attesting Officer*

*Commissioner of Patents and Trademarks*